US005854998A

United States Patent [19]

Flomen et al.

[11] Patent Number: 5,854,998

[45] **Date of Patent: *Dec. 29, 1998**

[54] SPEECH PROCESSING SYSTEM QUANTIZER OF SINGLE-GAIN PULSE EXCITATION IN SPEECH CODER

[75] Inventors: Felix Flomen; Leon Bialik, both of Rishon Lezion, Israel

[73] Assignee: AudioCodes Ltd., Or Yehuda, Israel

[ * ] Notice: The term of this patent shall not extend beyond the expiration date of Pat. No. 5,568,588.

[21] Appl. No.: 733,406

[22] Filed: Oct. 18, 1996

Related U.S. Application Data

[63] Continuation-in-part of Ser. No. 236,764, Apr. 29, 1994, Pat. No. 5,568,588.

[30] Foreign Application Priority Data

Oct. 19, 1995 [IL] Israel ..... 115698

[51] Int. Cl.[6] ..... G10L 5/00

[52] U.S. Cl. ..... 704/223; 704/216

[58] Field of Search ..... 704/219–223, 704/211, 225, 201, 200, 209, 264, 230, 216

[56] References Cited

U.S. PATENT DOCUMENTS 4,710,959 12/1987 Feldman et al. .
4,932,061 6/1990 Kroon et al. .
5,007,094 4/1991 Hsueh et al. .
5,060,269 10/1991 Zinser .
5,557,705 9/1996 Taguchi ..... 704/219

*Primary Examiner*—David R. Hudspeth
*Assistant Examiner*—Donald L. Storm
*Attorney, Agent, or Firm*—Skjerven, Morrill, MacPherson, Franklin & Friel LLP

[57] ABSTRACT

An improved speech processing system has a short-term analyzer, a target vector generator and a maximum likelihood, multi-pulse analyzer. The multi-pulse analyzer generates a plurality of sequences of equal amplitude, variable sign, variably spaced pulses. Each of the sequences have a different amplitude value and each of the pulses within each sequence have equal amplitudes but variable signs. The multi-pulse analyzer generates a signal corresponding to the sequence of equal amplitude, variable sign, variably spaced pulses which, according to maximum likelihood criteria, most closely represents the target vector. The maximum likelihood criteria are based on the cross-correlation of the target vector with an impulse response for the pulses in each sequence and on either a covariance matrix or an autocorrelation vector of the impulse response. In an alternative embodiment, the multi-pulse analyzer generates a plurality of sequences of variable sign trains of equal amplitude, uniformly spaced pulses and performs the analysis on the pulse trains. The pulses within each train have the same sign and each of the sequences of trains of pulses having a different amplitude value.

18 Claims, 11 Drawing Sheets

SPEECH PROCESSING SYSTEM QUANTIZER OF SINGLE-GAIN PULSE EXCITATION IN SPEECH CODER

RELATED APPLICATION

This application is a continuation-in-part application of copending and commonly assigned U.S. patent application Ser. No. 08/236,764, entitled "A Multi-Pulse Analysis Speech Processing System and Method" of Leon Bialik and Felix Flomen, filed on Apr. 29, 1994, which issued as U.S. Pat. No. 5,568,588 on Oct. 22, 1996.

FIELD OF THE INVENTION

The present invention relates to speech processing systems generally and to multi-pulse analysis systems in particular.

BACKGROUND OF THE INVENTION

Speech signal processing is well known in the art and is often utilized to compress an incoming speech signal, either for storage or for transmission. The speech signal processing typically involves dividing the incoming speech signals into frames and then analyzing each frame to determine its components. The components are then stored or transmitted.

Typically, the frame analyzer determines the short-term and long-term characteristics of the speech signal. The frame analyzer can also determine one or both of the short- and long-term components, or "contributions", of the speech signal. For example, linear prediction coefficient analysis (LPC) provides the short-term characteristics and contribution and pitch analysis and prediction provides the long-term characteristics as well as the long-term contribution.

Typically, either, both or neither of the long- and short-term predictor contributions are subtracted from the input frame, leaving a target vector whose shape has to be characterized. Such a characterization can be produced with multi-pulse analysis (MPA) which is described in detail in section 6.4.2 of the book *Digital Speech Processing, Synthesis and Recognition* by Sadaoki Furui, Marcel Dekker, Inc., New York, N.Y. 1989. The book is incorporated herein by reference.

In MPA, the target vector, which is formed of a multiplicity of samples, is modeled by a plurality of varying amplitude pulses (or spikes), of varying location and varying sign (positive and negative). To select each pulse, a pulse is placed at each sample location and the effect of the pulse, defined by passing the pulse through a filter defined by the LPC coefficients, is determined. The pulse which provides most closely matches the target vector is selected and its effect is removed from the target vector, thereby generating a new target vector. The process continues until a predetermined number of pulses have been found. For storage or transmission purposes, the result of the MPA analysis is a collection of pulse locations and a quantized value of the amplitudes of the pulses.

SUMMARY OF THE PRESENT INVENTION

It is therefore an object of the present invention to provide an improved speech processing system. In one embodiment of the present invention, the system includes a short-term analyzer, a target vector generator and a maximum likelihood quantization (MLQ) multi-pulse analysis unit. The short-term analyzer determines the short-term characteristics of an input speech signal. The target vector generator generates a target vector from at least the input signal. The MLQ multi-pulse analysis unit operates on the resultant target vector.

The MLQ multi-pulse analysis unit typically determines an initial gain level for the multi-pulse sequence and performs single amplitude MPA a number of times, each with a different amplitude level. The amplitude levels are within a range above and below the initial gain level. The resultant pulses can be positive or negative.

Like in other maximum likelihood applications, the quality of the result is measured. In this invention, the maximum likelihood criteria are based on the cross-correlation of the target vector with an impulse response for the pulses in each sequence and on a covariance matrix (or, alternatively, an autocorrelation vector) of said impulse response. The pulse sequence with the "best" criterion and its corresponding amplitude level (or the index for the amplitude level) is then provided as the output signal of the MLQ multi-pulse analysis unit.

In an alternative embodiment, the system includes a long-term prediction analyzer and replaces the MLQ multi-pulse analysis unit with a pulse train multi-pulse analysis unit. In this embodiment, the pulse train multi-pulse analysis unit utilizes a pitch distance from the long-term analyzer to create a plurality of sequences of trains of equal amplitude, same sign pulses, each the pitch distance apart from the previous pulse in the train. The multi-pulse analysis unit then outputs a signal representing the sequence of pulse trains, including positive and negative pulse trains, which best represents the target vector in accordance with the maximum likelihood criteria described hereinabove.

In a final further embodiment, the output of the maximum likelihood and pulse train multi-pulse analysis units are compared and the sequence which represents the closest match to the target vector is provided as the output signal.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

Figure 1:
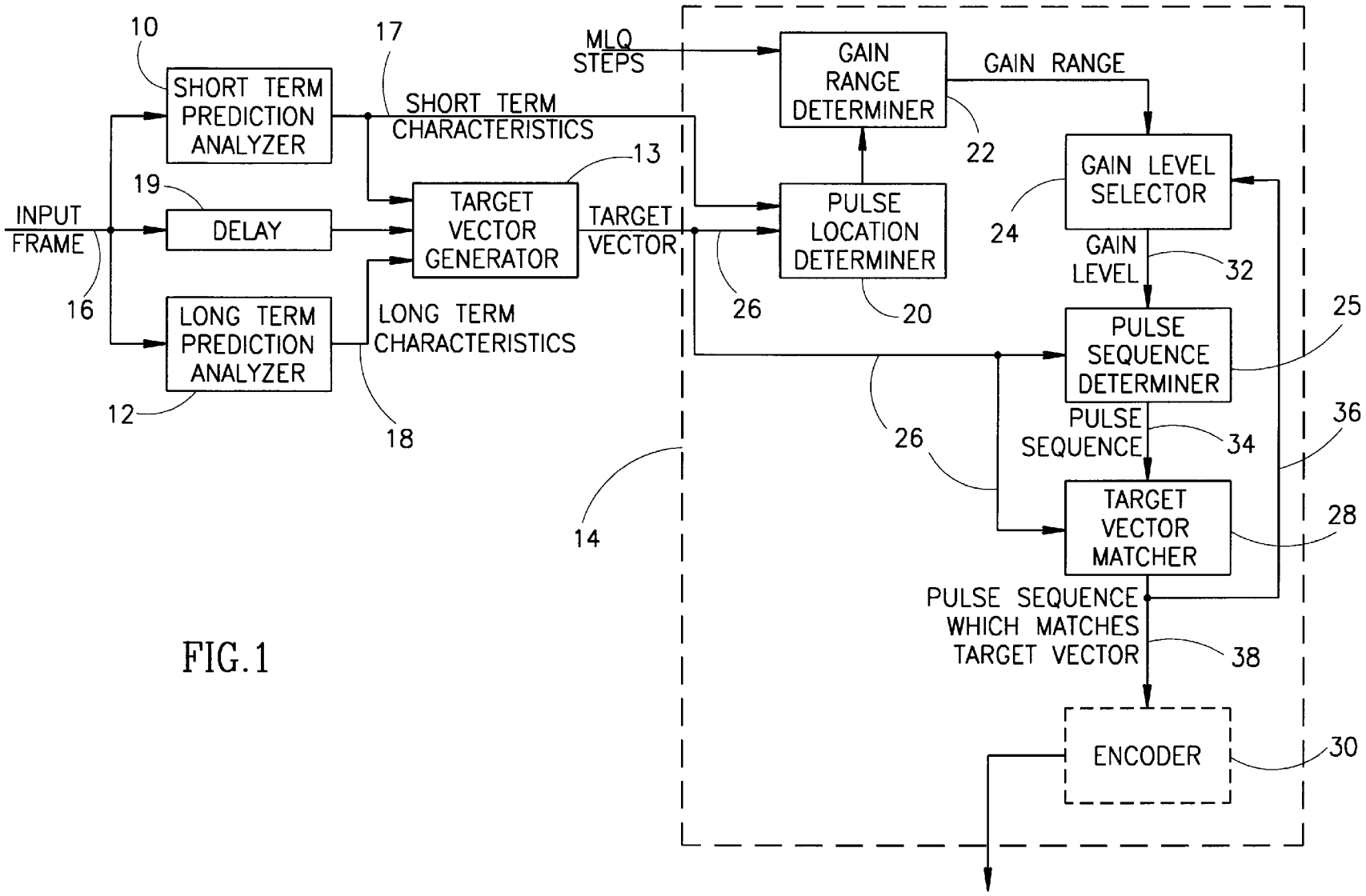
FIG. 1 is a block diagram illustration of a first embodiment of the speech processing system of the present invention.

Reference is now made to FIGS. 1, 2, 3A and 3B which illustrate a first embodiment of the present invention. The speech processing system of the present invention includes at least a short-term prediction analyzer 10, a long-term prediction analyzer 12, a target vector generator 13 and a maximum likelihood quantization multi-pulse analysis (MP-MLQ) unit 14.

Short-term prediction analyzer 10 receives, on input line 16, an input frame of a speech signal formed of a multiplicity of digitized speech samples. Typically, there are 240 speech samples per frame and the frame is often separated into a plurality of subframes. Typically, there are four subframes, each typically 60 samples long. The input frame can be a frame of an original speech signal or of a processed version thereof.

Short-term prediction analyzer 10 also receives, on input line 16, the input frame and produces, on output line 17, the short-term characteristics of the input frame. In one embodiment, analyzer 10 performs linear prediction analysis to produce linear prediction coefficients (LPCs) which characterize the input frame.

For the purposes of the present invention, analyzer 10 can perform any type of LPC analysis. For example, the LPC analysis can be performed as described in chapter 6.4.2 of the book *Digital Speech Processing, Synthesis and Recognition,* as follows: a Hamming window is applied to a window of 180 samples centered on a subframe. Tenth order LPC coefficients are generated, using the Durbin recursion method. The process is repeated for each subframe.

Long-term predictor analyzer 12 can be any type of long-term predictor and operates on the input frame received on line 16. Long-term analyzer 12 analyzes a plurality of subframes of the input frame to determine the pitch value of the speech within each subframe, where the pitch value is defined as the number of samples after which the speech signal approximately repeats itself. Pitch values typically range between 20 and 146, where 20 indicates a high-pitched voice and 146 indicates a low-pitched voice.

For example, for every two subframes, a pitch estimate can be determined by maximizing a normalized cross-correlation function of the subframes s(n), as follows:

$$C_i = \frac{\sum_{k=0}^{119} s(k)s(k-i)}{\sum_{k=0}^{119} s(k-i)s(k-i)} \tag{1}$$

where i varies from 20 to 146. For this example, long-term analyzer 12 selects the index i which maximizes cross-correlation $C_i$ as the pitch value for the two subframes.

Once the long-term analyzer 12 determines the pitch value, the pitch value is utilized to determine the long-term prediction information for the subframe, provided on output line 18.

The target vector generator 13 receives the output signals of the long-term analyzer 12 and the short-term analyzer 10 as well as the input frame on input line 16, via a delay 19. In response to those signals, target vector generator 13 generates a target vector from at least a subframe of the input frame. The long- and short-term information can be utilized, if desired, or they can be ignored. The delay 19 ensures that the input frame which arrives at the target vector corresponds to the output of the analyzers 10 and 12.

An output line 26 of target vector generator 13, which is connected to the MP-MLQ unit 14, carries the target vector output signal. The MP-MLQ unit 14 is typically also connected to output line 17 carrying the short-term characteristics produced by analyzer 10.

It will be appreciated that, without any loss of generality, the target vector to the MP-MLQ unit 14 can be produced in any other desired manner.

In accordance with the first preferred embodiment of the present invention, the MP-MLO unit 14 includes an initial pulse location determiner 20, a gain range determiner 22, a gain level selector 24, a pulse sequence determiner 25, a target vector matcher 28 and an optional encoder 30. The specific operations performed by elements 20–30 are illustrated in FIG. 2 and are described in detail hereinbelow. The following is a general description of the operation of unit 14.

The initial pulse location determiner 20 receives the output signals of the target vector generator 13 and the short-term analyzer 10 along output lines 17 and 26, respectively. It determines the sample location of a first pulse in accordance with multi-pulse analysis techniques.

The gain range determiner 22 receives the first pulse output of unit 20 and determines both an amplitude of the first pulse and a range of quantized gain levels around the absolute value of the determined amplitude. The step size, labeled MLQ_STEPS, for moving through the range of quantized gain levels, typically has a value of 3 amplitude units. The step size, MLQ_STEPS, is not determined by MP_MLQ unit 14.

The gain level selector 24 receives the gain range produced by gain range determiner 22 and moves through the gain values within the gain range. Its output, on output line 32, is a current gain level for which a sequence of equal amplitude pulses, is to be determined.

The pulse sequence determiner 25 receives the target vector, on line 26, and the current gain level, on line 32, and determines therefrom, using multi-pulse analysis techniques as described hereinbelow, a pulse sequence (with both positive and negative pulses) which matches the target vector. The pulse sequence is a series of positive and negative pulses having the current gain level.

The target vector matcher 28 receives the pulse sequence output, on output line 34, of determiner 25, and the target vector, on output line 26. Matcher 28 determines the quality of the match by utilizing a maximum likelihood type criterion.

Since there are a range of gain levels, the matcher 28 returns control to the gain level selector 24 to select the next gain level. This return of control is indicated by arrow 36.

For each gain value, matcher 28 determines the quality of the match, saving the match (gain index and pulse sequence) only if it provides a smaller value for the criterion than previous matches.

Once gain selector 24 has moved through all of the gain values, the gain index and pulse sequence which is in storage in matcher 28 is the closest match to the target vector. Matcher 28 then outputs the stored pulse sequence and gain index along output line 38 to optional encoder 30.

It will be appreciated that, by determining a pulse sequence for each of a few gain levels, the MP-MLQ unit 14 can select the one which most closely matches the target vector.

Optional encoder 30 encodes the output pulse sequence and gain as index for storage or transmission.

Figure 2A:
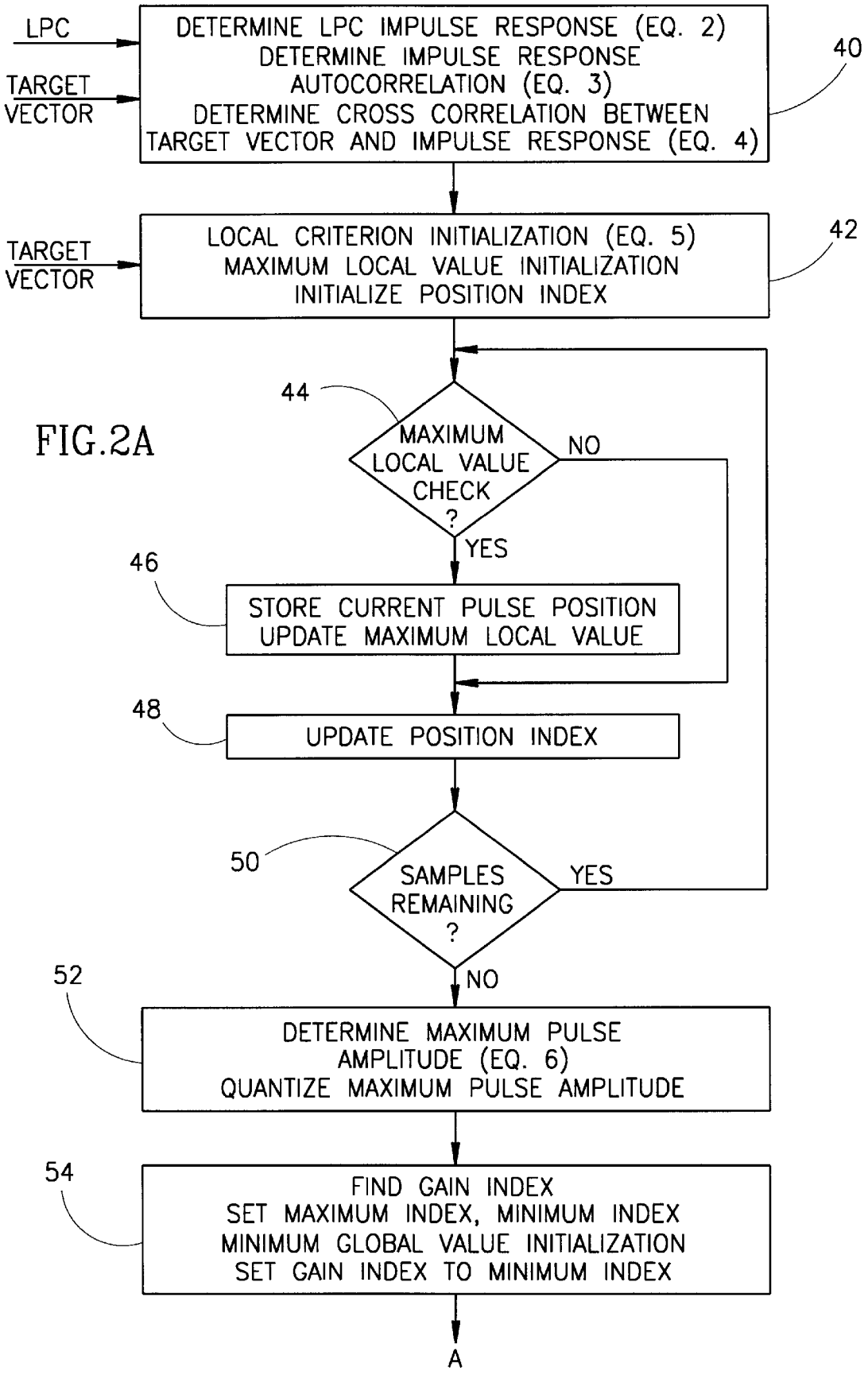
FIGS. 2A, 2B and 2C are a flow chart illustration of the operations of an multi-pulse, maximum likelihood quantization (MP-MLQ) block of FIG. 1.
Figure 2B:
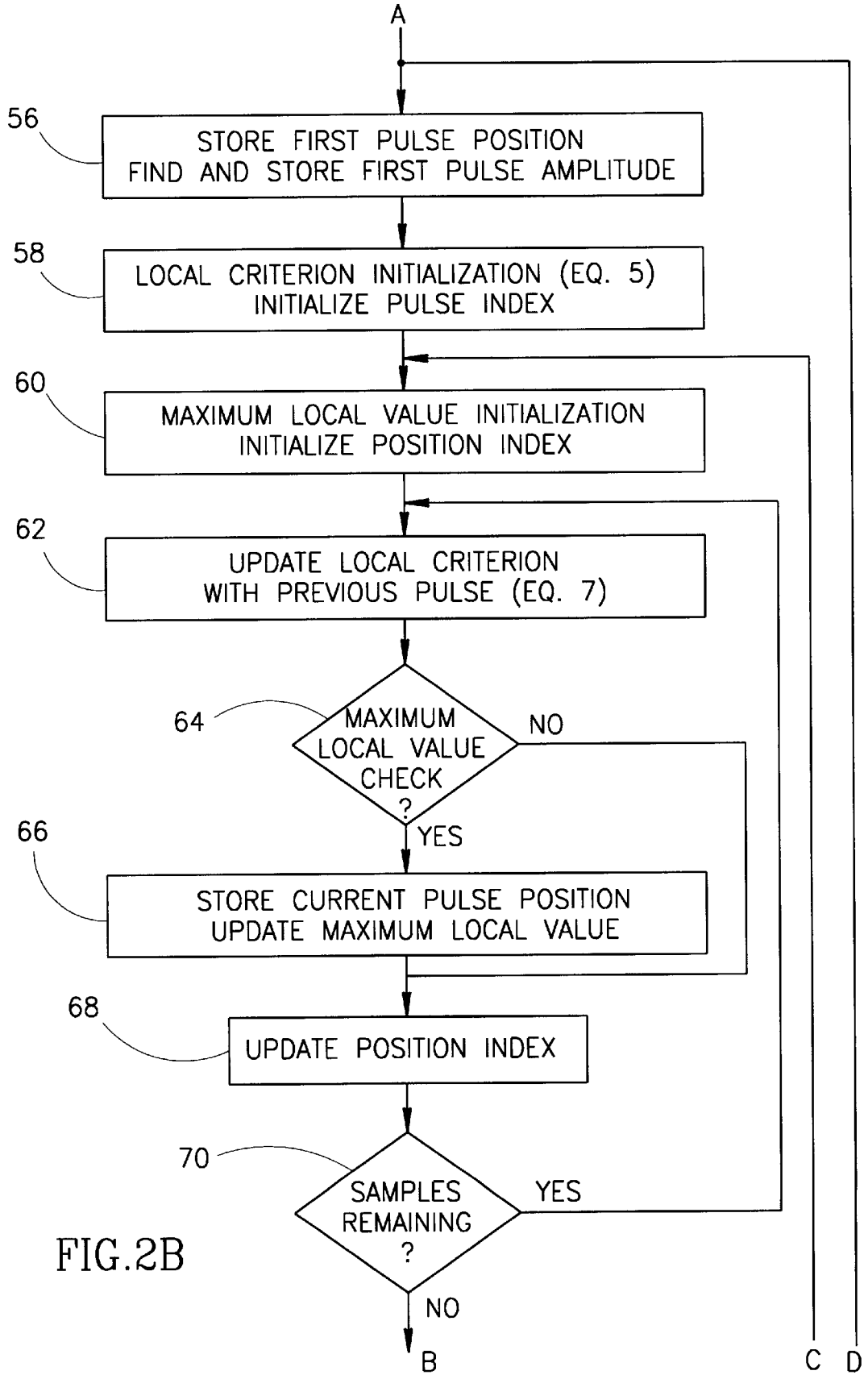
Figure 2C:
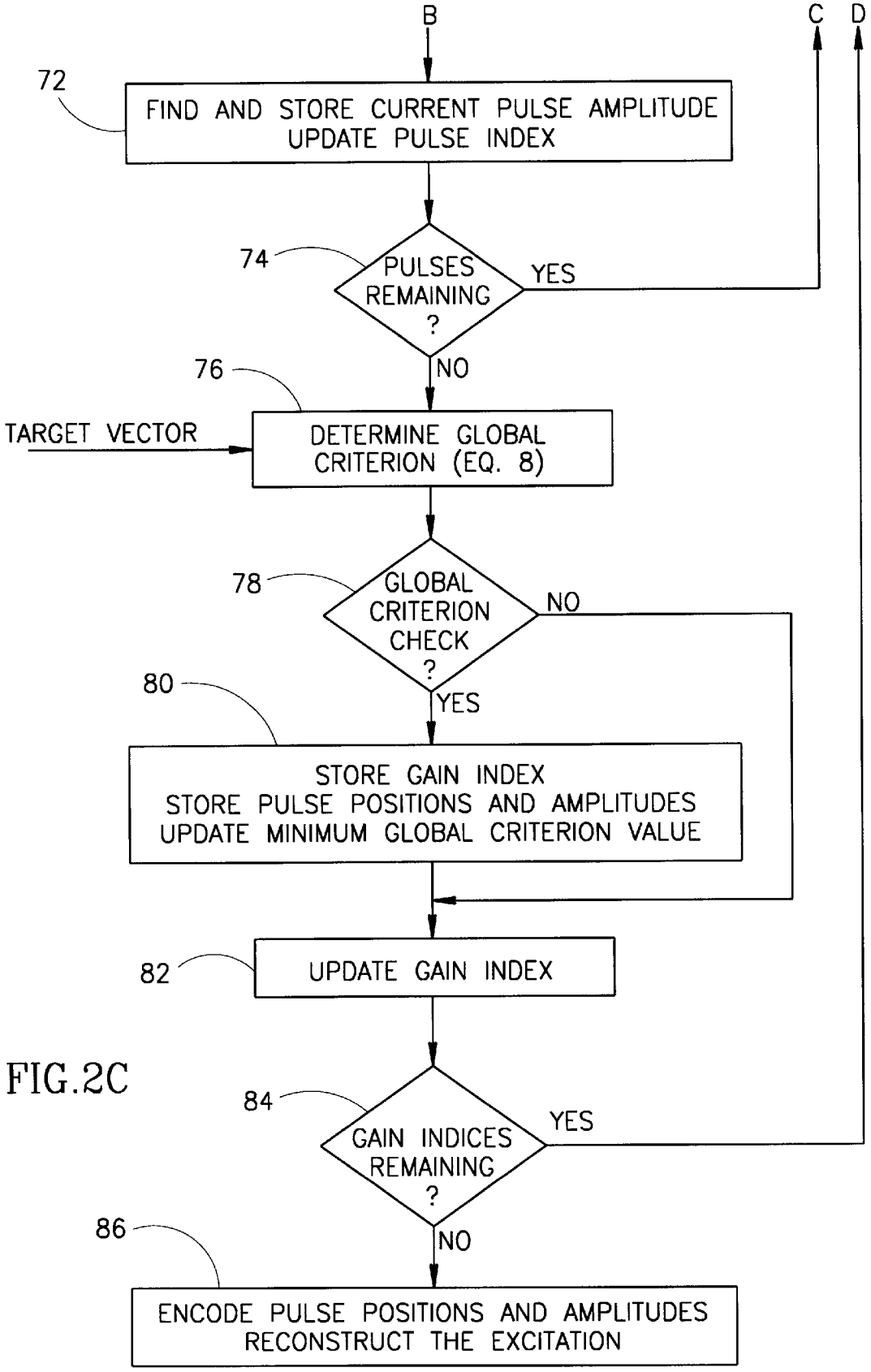

The specific operations of the MP-MLQ unit 14 are shown in FIGS. 2A, and 2B and 2C; In initialization step 40, unit 14 generates the following signals:

a) an impulse response h[n] for the input frame from the short-term characteristics $a_i$ defined as:

$$h[n] = \sum_{i=1}^{P} a_i h[n-i] + \delta[n],\ 0 \leqq n \leqq N-1 \tag{2}$$

$$h[-n]=0, n=1..P$$

where P is the order of short-term filter and N is the number of speech samples in the subframe b) the result $r_{hh}[l]$ of an impulse response autocorrelation, for each sample position l, as follows:

$$r_{hh}[l] = \sum_{n=l}^{N-1} h[n]h[n-l],\ 0 \leqq l \leqq N-1 \tag{3}$$

and c) the result $r_{th}[l]$ of a cross-correlation between the impulse response h[n] and the target vector t[n], for each sample position l, as follows:

$$r_{th}[l] = \sum_{n=l}^{N-1} t[n]h[n-l],\ 0 \leqq l \leqq N-1 \tag{4}$$

It will be appreciated that the impulse response is a function of the short-term characteristics $a_i$ provided along line 17 from analyzer 10. The impulse response generated in initialization step 40 corresponds to the Durbin LPC analysis mentioned hereinabove.

The MP-MLQ unit 14 utilizes a local criterion $LC_{kj}[l]$ to determine a quantitative value for each sample position 1, each pulse k and each gain level j. As will be seen hereinbelow, the level of the local criterion is dependent on the value of k (i.e. on the number of pulses already determined).

In step 42, the local criterion $LC_{o,j}[l]$ for the first pulse determination is initialized to the cross-correlation function $r_{th}[l]$, as follows:

$$LC_o[l]=LC_{0,j}[l]=r_{th}[l],\ 0\leqq l\leqq N-1, j_{min}\leqq j\leqq j_{max} \tag{5}$$

A maximum local value for the local criterion is also set to some negative value. The position index l is also initialized to 0.

In steps 44–50 the position l of the first pulse k=1 is determined. To do so, the absolute value of the local criterion $LC_{o,j}[l]$ is compared to the maximum local value (step 44). If $LC_{o,j}[l]$ is larger, the position l is stored, the maximum local value is set to the absolute value of the local criterion $LC_{0,j}[l]$ (step 46) and the position index I is increased by 1 (step 48). The operation is repeated until all the positions l have been reviewed. The sample position $l_{opt}$ which is in storage after all of the positions have been reviewed is the selected sample position $l_{opt}$. Steps 40–50 are performed by the pulse location determiner 20.

Step 52 is performed by the gain range determiner 22. In step 52, maximum amplitude $A_{max}$ of the position l which produced the largest local criterion $LC_{o,j}[l]$ is generated as follows:

$$A_{max} = A_{max,j} = \frac{|LC_{0,j}[l_{opt}]|}{r_{hh}[0]},\ j_{min} <= j \leqq j_{max} \tag{6}$$

where $l_{opt}$ is the position of the first pulse. The maximum value $A_{max}$ is then approximated by one of a predetermined set of gain levels. For example, if the expected amplitude levels are in the range of 0.1–2.0 units, the gain levels might be every 0.1 units. Thus, if $A_{max}$ is 0.756, it is quantized to 0.8.

Steps 54–58 are performed by the gain selector 24. In step 54, gain selector 24 determines the gain index j associated with the determined gain level as well as a range of gain indices around gain index j. The range of gain levels can be any size depending on the predetermined value of MLQ_STEPS. In step 54, the gain selector 24 sets the gain index to the minimum one. For the previous example, 0.1 might have an index 1 and MLQ_STEPS might be 3. Thus, the determined gain index is 8 and the range is between indices 5–11. Step 54 also sets a minimum global value to any very large value, such as $10^{13}$.

In the present invention, for each gain index, the first pulse is the location of the pulse determined by the pulse location determiner 20 (in steps 44 –50). The remaining pulses can be anywhere else within the subframe and can have positive or negative gain values. In step 56, the gain selector 24 stores the first pulse position and its amplitude. In step 58, the local criterion $LC_{k,j}[l]$, for the present pulse index k and gain index j is initialized, typically in accordance with equation 5.

Pulse sequence determiner 25 performs steps 60–74. In step 60, determiner 25 sets the maximum local value to a large value, as before, and sets the position index l to 0.

In step 62, determiner 25 updates the local criterion with the previous pulse, as follows:

$$LC_{k,j}[l]=LC_{k-1,j}[l]-A_{k-1,j}r_{hh}[l-l_{opt\ k-1,j}] \tag{7}$$

j=gain index k=pulse index l=position index $A_{k-1,j}$=the positive or negative amplitude of pulse k−1, for the jth gain level.

In the loop of steps 64–70, pulse sequence determiner 25 determines the location of a pulse in a manner similar to that performed in steps 44–50 and therefore, will not be further described herein. In step 72, determiner 24 stores the selected pulse and in step 74, it updates the pulse value. Steps 62–74 are repeated for each pulse in the sequence, the result of which is the pulse sequence output of pulse sequence determiner 25. It is noted that step 62 updates the local criterion for each pulse which is found.

Figure 3A:
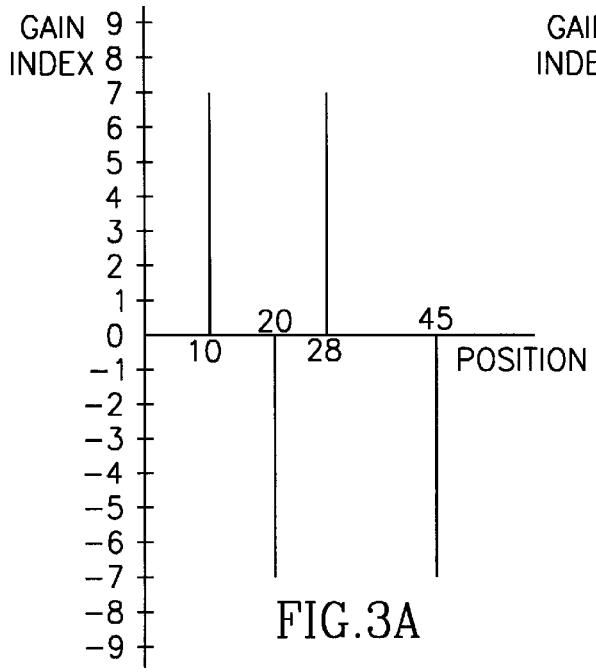
FIGS. 3A and 3B are graphical illustrations, useful in understanding the operations of FIG. 2.
Figure 3B:
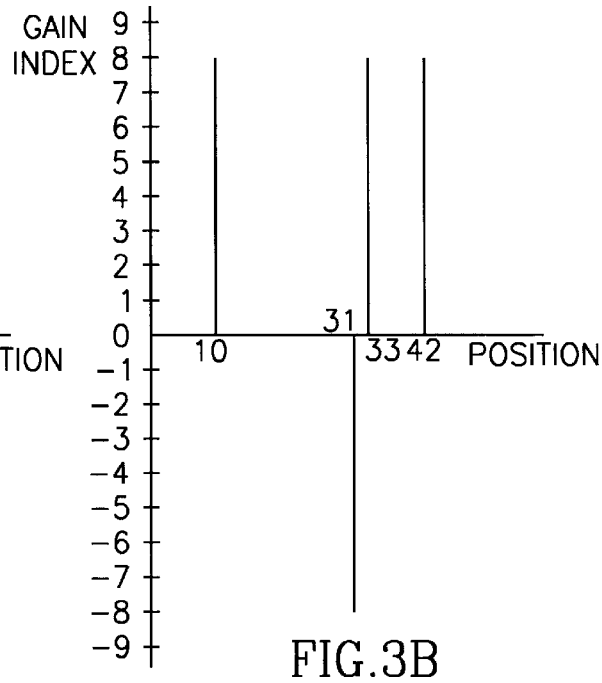

FIGS. 3A and 3B illustrate two examples of different pulse sequence outputs of pulse sequence determiner 25. The sequence of FIG. 3A has a gain index of 7 and the sequence of FIG. 3B has a gain index of 8. Both sequences have the same first sample position 10 but the rest of the pulses are at other positions. It is noted that the pulses can be positive or negative.

In step 76, target vector matcher 28 determines the value of a global criterion $GC_j$ for each gain level j. The global criterion $GC_j$ can be any appropriate criterion and is typically a maximum likelihood type criterion. For example, the global criterion can measure the energy in an error vector defined as the difference between the target vector and an estimated vector produced by filtering the single gain pulse sequence through a perceptual weighting filter, in this case defined by the short-term characteristics. For such a criterion, target vector matcher 28 includes a perceptual weighting filter.

It will be appreciated that the pulse sequence, per se, does not match the target vector; the pulse sequence represents a function which matches the target vector.

As given in equations 8a–8e hereinbelow, the global criterion GCO is comprised of two elements, $p_j$ and $d_j$, both of which are functions of a signal $x_j[n]$ which is the pulse series for the gain level j filtered by the short-term impulse response h[n]. $P_j$ is the cross-correlation between the target vector t[n] and x[n] and $d_j$ is the energy of $x_j[n]$.

$$GC_j = 2p_j + d_j \tag{8}$$

-continued $$p_j = \sum_{n=0}^{N-1} t[n]x_j[n]$$

$$d_j = \sum_{n=0}^{N-1} x_j[n]x_j[n]$$

$$x_j[n] = \sum_{i=0}^{n} v_j[i]h[n-i],\ 0 \leqq n \leqq N-1$$

$$v_j[n] = \begin{matrix} A_{k,j} \text{ if } n = l_{opt_{k,j}},\ 0 \leqq k \leqq K-1 \\ 0 \text{ otherwise} \end{matrix}$$

In step 78, the global criterion $GC_j$ for the present gain index j is compared to the present minimum global value. If it is less than the present minimum global value, as checked in step 78, the target vector matcher 28 stores (step 80) the gain index and its associated pulse sequence.

In step 82, the gain level selector 24 updates the gain index and, in step 84 it checks whether or not pulse sequences have been determined for all of the gain levels. If so, the pulse sequence and gain index which are in storage are the ones which best match the target vector in accordance with the global criterion $GC_j$.

In step 86, optional encoder 30 encodes the pulse sequence and gain index as output signals, for transmission or storage, in accordance with any encoding method. If desired, the target vector can be reconstructed using $x_j$opt [n], where jopt is the gain index resulting from step 84.

It will be appreciated that the MP-MLQ unit 14 of the present invention provides, as output signals, at least the selected pulse sequence and the gain level.

Figure 4A:
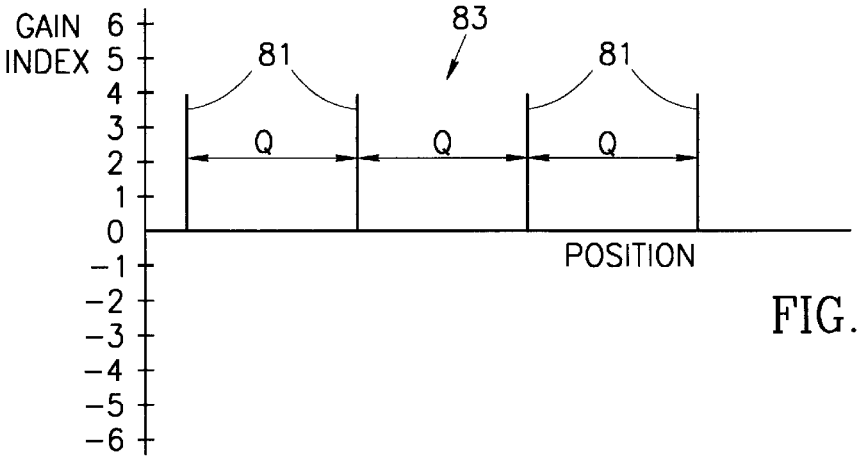
FIGS. 4A and 4B are graphical illustration describing pulse trains and multi-pulse analysis using pulse trains, respectively.

Reference is now made to FIGS. 4A, 4B, 5 and 6A, 6B and 6C; which illustrate an alternative embodiment of the present invention which utilizes pulse trains. A pulse train 83 is illustrated in FIG. 4A. It comprises a series of pulses 81 separated by a distance Q which is the pitch.

Figure 4B:
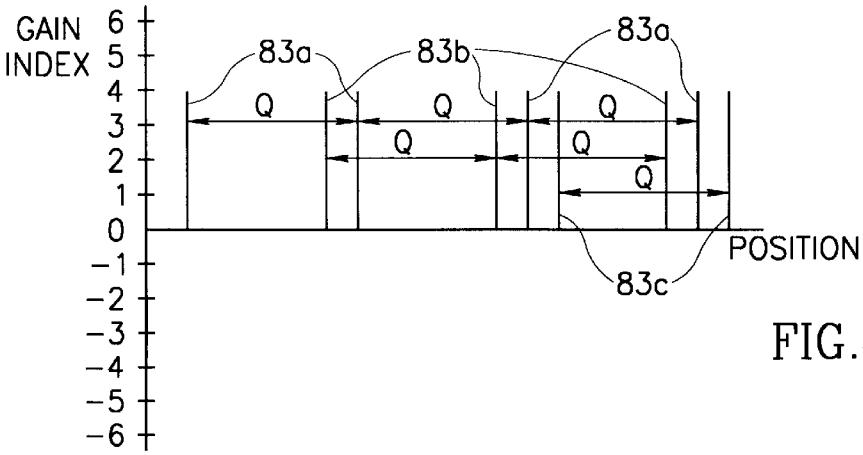
Figure 5:
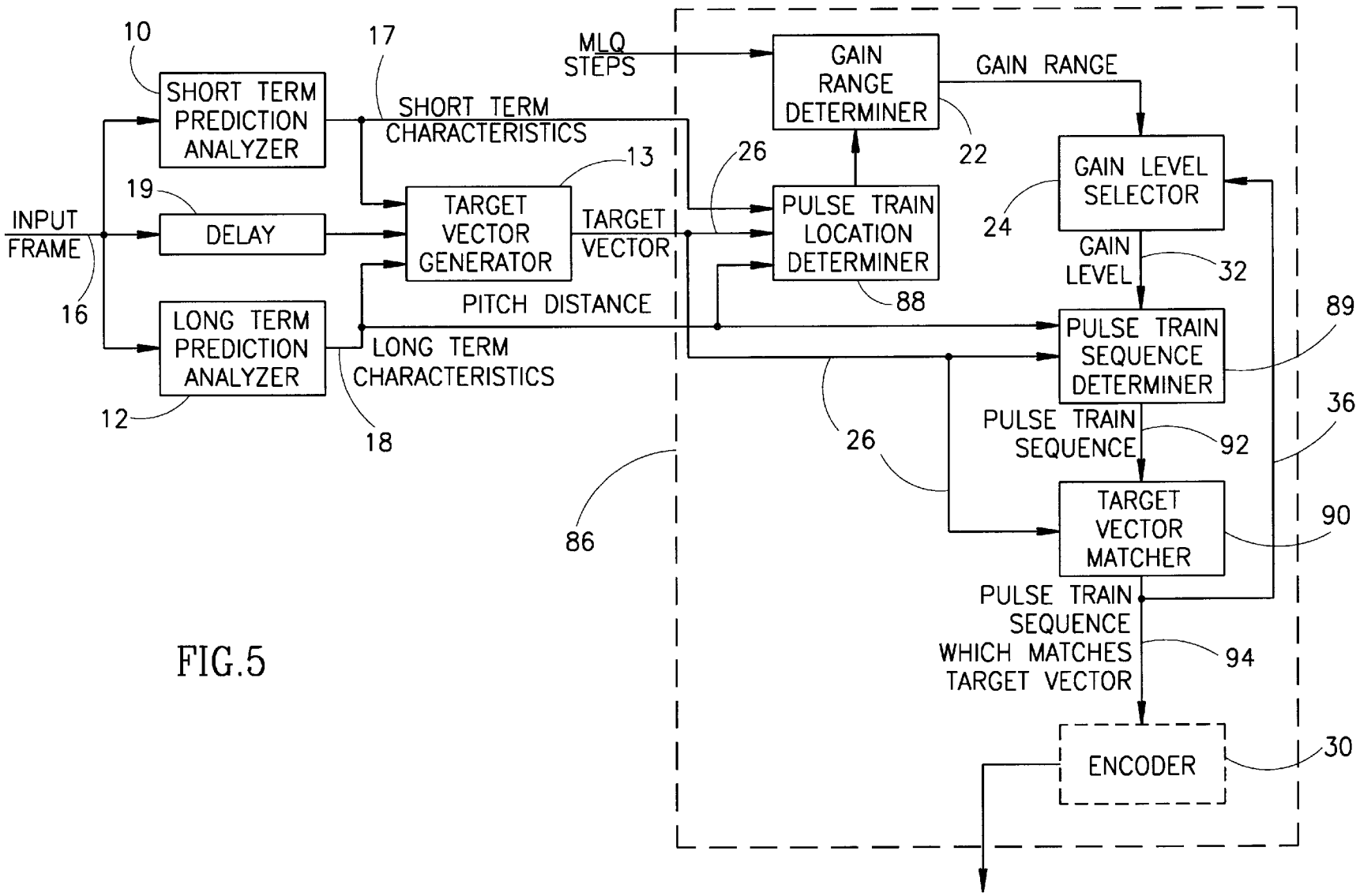
FIG. 5 is a block diagram illustration of a second embodiment of the speech processing system of the present invention utilizing pulse trains.

In the system shown in FIG. 5, a sequence of pulse trains are found which most closely match a target vector. FIG. 4B illustrates an example sequence of three pulse trains 83*a*, 83*b* and 83*c* which might be found. Each pulse train 83 begins at a different sample position. Pulse train 83*a* is the first and comprises four pulses. Pulse train 83*b* begins at a later position and comprises three pulses and pulse train 83*c*, starting at a much later position, comprises only two pulses.

The system of FIG. 5 is similar to that of FIG. 1; the only differences being that a) the pulse location determiner 20 and pulse sequence determiner 25 of FIG. 1 are replaced by pulse train location determiner 88 and pulse train sequence determiner 89; b) the target vector matcher, labeled 90, operates on pulse train sequences rather than pulse sequences; and c) the determiners 88 and 89 receive the pitch value Q along output line 18. In addition, the output lines 34 and 38 are replaced by output lines 92 and 94 which carry signals representing sequences of pulse trains rather than sequences of pulses.

Pulse train determiner 88 operates similar to pulse determiner 20 except that determiner 88 utilizes a pulse train impulse response $h_\tau[n]$ rather the pulse impulse response h[n]. $h_\tau[n]$ is defined as:

$$h_T[n] = \sum_{k=0}^{(N-1)/Q} h[n-kQ],\ 0 \leqq n \leqq N-1 \tag{9}$$

where Q is the pitch value. As can be seen, the pulse trains at later positions typically have fewer pulses.

The pulse train impulse response autocorrelation of equation 3 becomes:

$$r_{hh}[l] = \sum_{n=l}^{N-1} h_T[n]h_T[n-l],\ 0 \leqq l \leqq N-1 \tag{10}$$

and the cross-correlation rth[l] between the impulse response $h_\tau[n]$ and the target vector t[n], for each sample position l, becomes:

$$r_{th}[l] = \sum_{n=l}^{N-1} t[n]h_T[n-l],\ 0 \leqq l \leqq N-1 \tag{11}$$

Pulse train sequence determiner 89 operates similarly to pulse sequence determiner 25 but determiner 89 generates pulse train sequences.

Target vector matcher 90 operates similarly to target vector matcher 28; however, matcher 90 utilizes the pulse train impulse response function $h_\tau[n]$ rather than h[n]. Thus, equation 8d becomes:

$$x_j[n] = \sum_{[i=0}^{n} v_j[i]h_T[n-i],\ 0 \leqq n \leqq N-1 \tag{12}$$

Figure 6A:
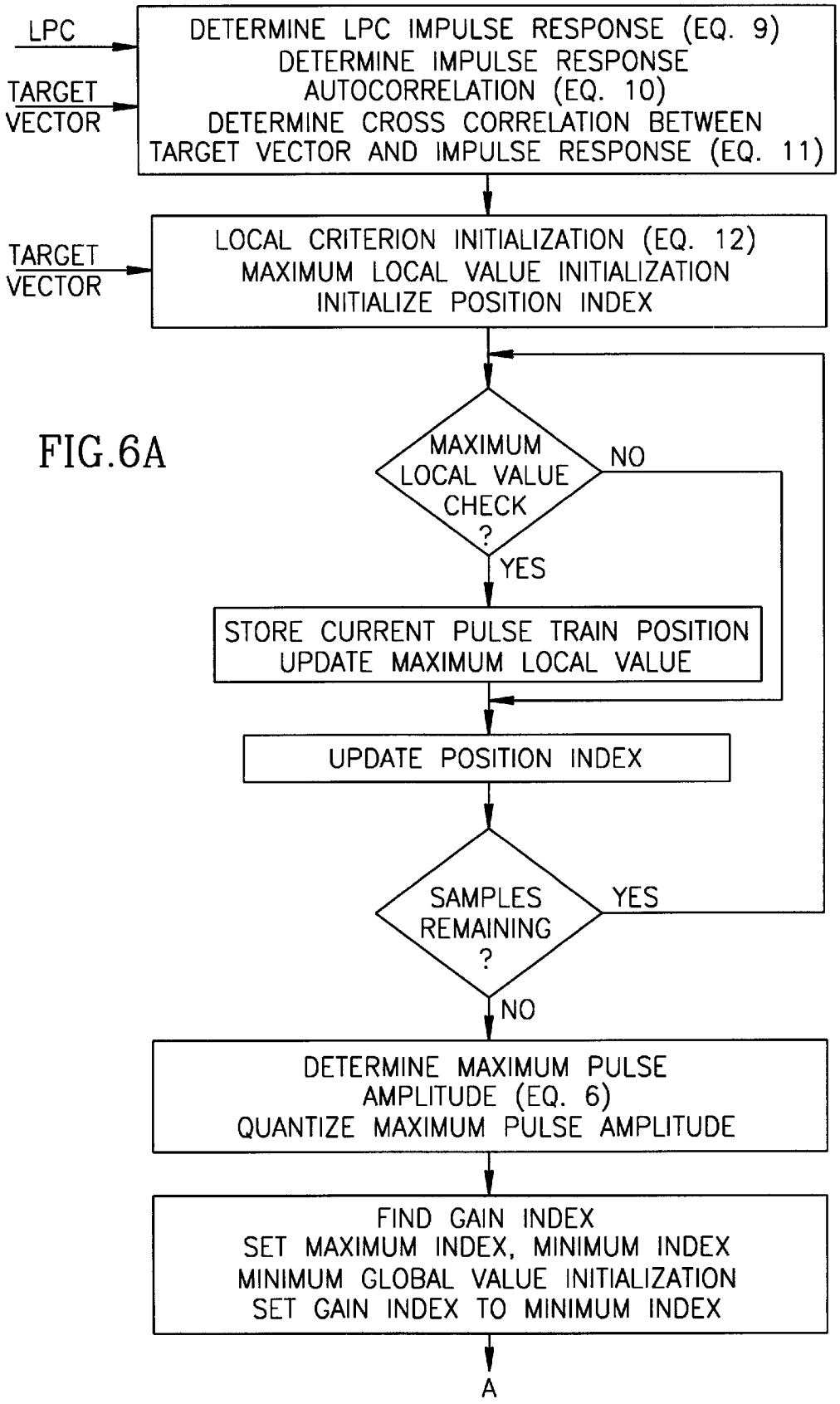
FIGS. 6A, 6B and 6C are a flow chart illustration of the operations of the pulse train multi-pulse analysis unit of FIG. 5.
Figure 6B:
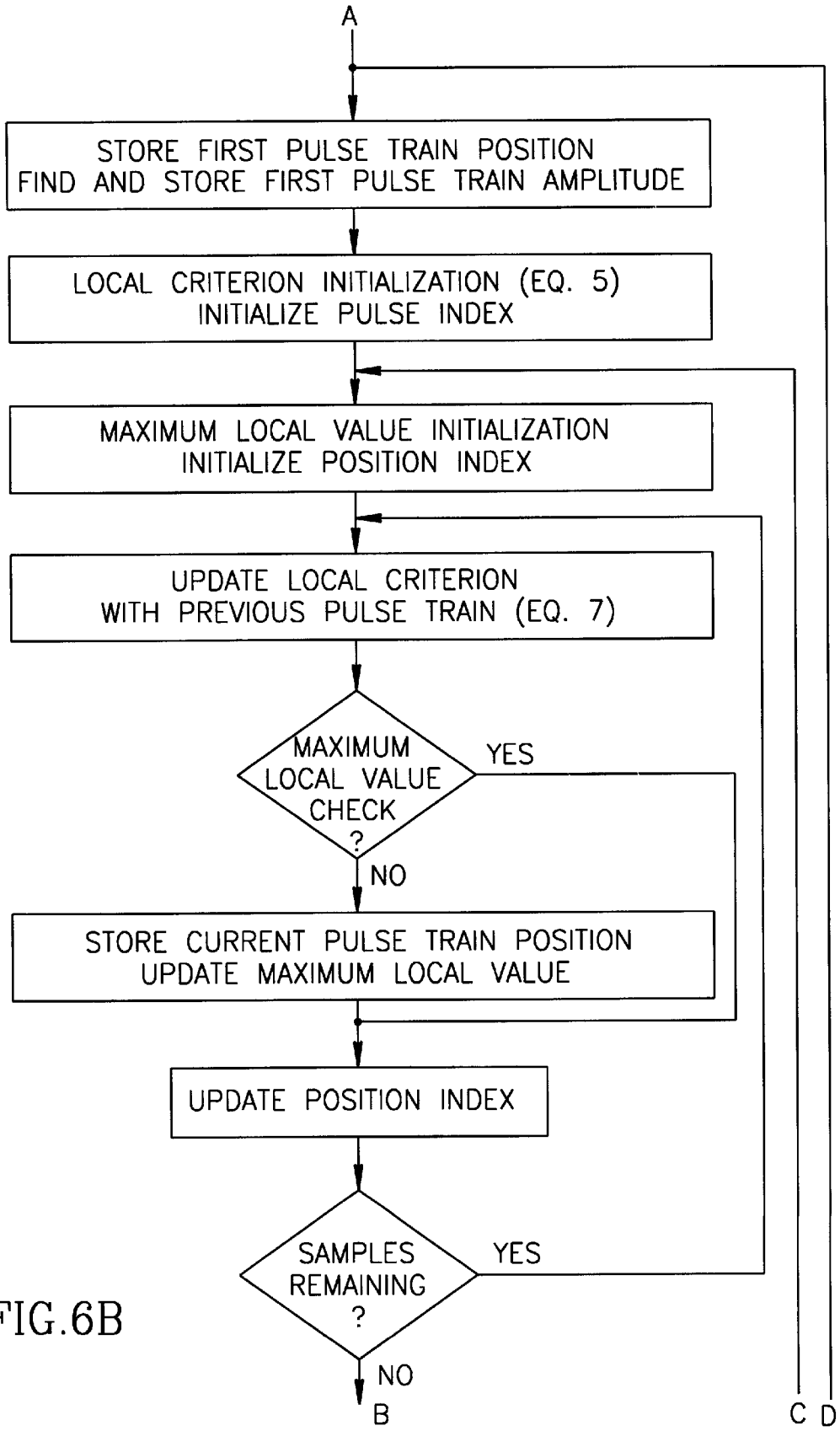
Figure 6C:
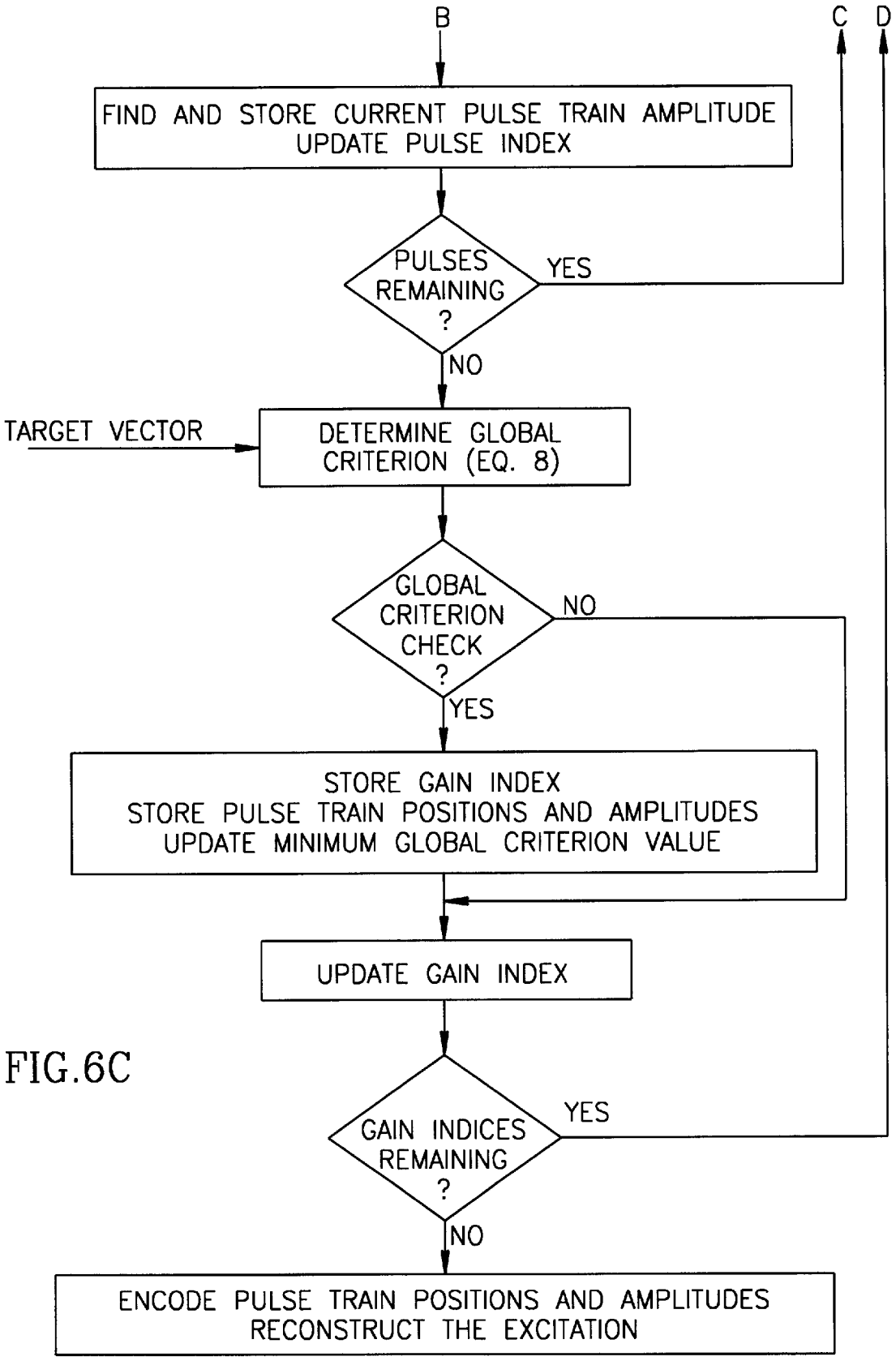

The specific operations of the pulse train multi-pulse analysis unit 86 are shown in FIGS. 6A, 6B, and 6C. The steps are equivalent to those shown in FIG. 2; however, the equations operate on pulse trains rather than individual pulses. Thus, in equation 9, a pulse train impulse response $h_\tau[n]$ is defined which has pulses every Q steps. The pulse trains at later positions typically have fewer pulses.

The remaining equations are similar except that they operate on the impulse response $h_\tau[n]$.

If it is desired, the gain range determined by gain range determiner 22 can have only one gain index. In this embodiment, pulse train multi-pulse analysis unit 86 determines the pulse train sequence which has the gain level of the first pulse train sequence. In this embodiment, the target vector matcher 90 does not operate, nor is there any repeating of the operations of gain level selector 24 and pulse train sequence determiner 89.

Figure 7:
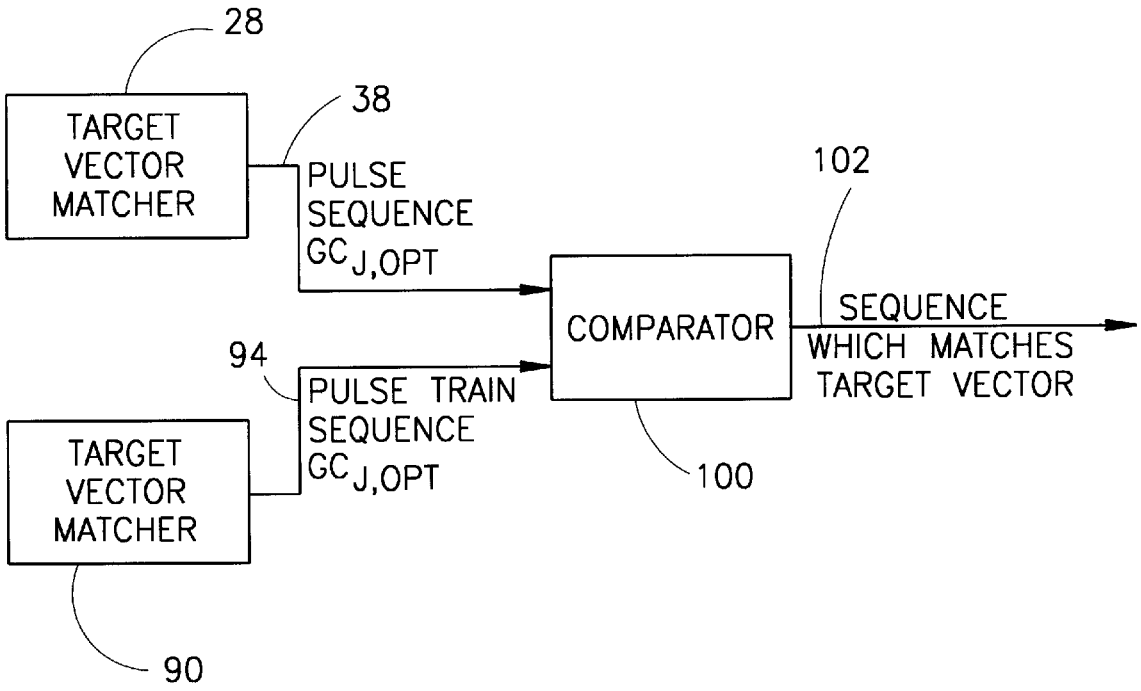
FIG. 7 is a block diagram illustration of a third embodiment comparing the output of the systems of FIGS. 1 and 5.

It will further be appreciated that the output of target vector matchers 28 and 90 can be compared. This is illustrated in FIG. 7 to which reference is now made. The output signals of matchers 28 and 90, representing the sequences and global criteria, are provided, along output lines 38 and 94 to a comparator 100. Comparator 100 compares global criteria $GC_{j,opt}$ from matchers 28 and 90 and selects the lowest one. An output signal representing the resulting sequence, pulse or pulse train, is provided along output line 102.

It will still further be appreciated that the pulse locations l can be restricted to a portion of the possible sample positions. For example, the subgroups of positions can be all of the even samples or all of the odd samples. In this embodiment, the pulse or pulse train multi-pulse analysis units perform the relevant multi-pulse analysis on both subgroups of positions and comparator 100 selects the sequence having the lowest global criterion $GC_{j,opt}$.

Figure 8A:
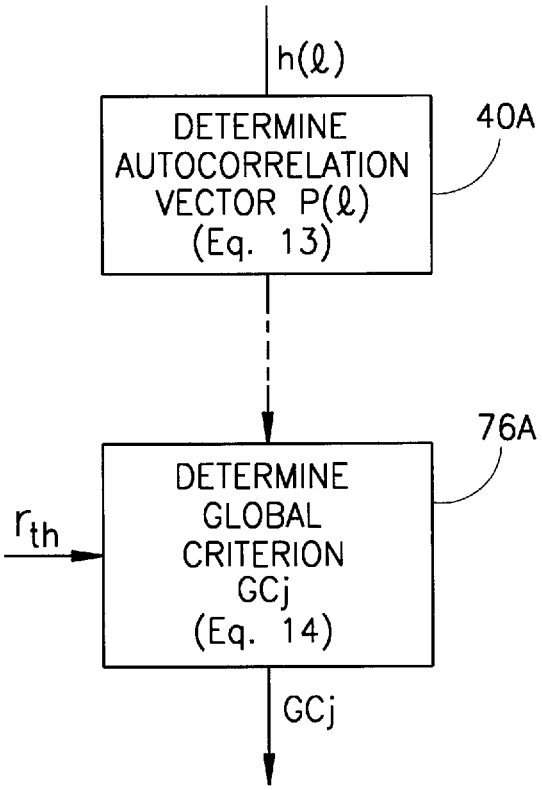
FIGS. 8A and 8B are flow chart illustrations of alternative methods of determining a global criterion.
Figure 8B:
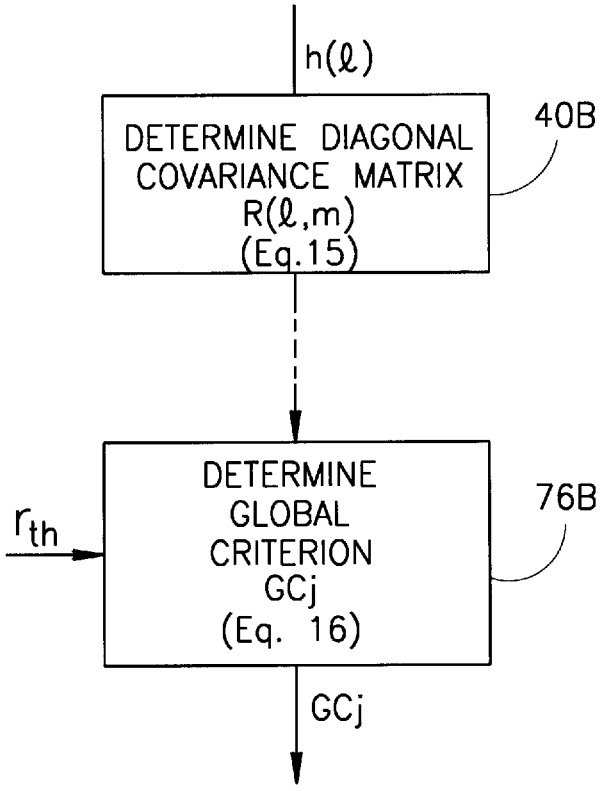

In accordance with alternative embodiments of the present invention and as illustrated in FIGS. 8A and 8B, the global criterion calculation (step 76) of the target vector matchers 28 and 90 utilizes fewer computation operations than those of equations 8. Rather than calculating a convolution in time (as in equation 8), the alternative embodiments utilizes correlations. To do so, the alternative embodiments utilize the previously calculated vector $r_{th}$ and, in initialization steps 40A or 40B, respectively determine either the autocorrelation vector P[l] or the covariance matrix R.

The autocorrelation vector P is defined as:

$$P[l] = \sum_{n=l}^{N-1} h(n)h(n-l),\ 0 \leqq l \leqq N-1 \tag{13}$$

where P[l] is one element of the vector P.

In this embodiment, the global criterion GCj is determined (in step 76A of FIG. 8A) from the cross-correlation vector rth and the autocorrelation vector P, as follows:

$$GC_j - 2G_j \sum_{k=0}^{M-1} \beta_k r_{th}(s_k) - G_j^2 * M * P(0) - 2G_j^2 \sum_{k=0}^{M-1} \sum_{i=k+1}^{M-1} \beta_k \beta_i P(|s_k - s_i|) \tag{14}$$

where $s_k$ is the location of the kth pulse in the sequence, $\beta_k$ is the sign of the pulse, $G_j$ is the gain for iteration j (without the sign) and M is the number of pulses in the sequence.

For the embodiment of either even or odd pulse locations, $|S_k - S_i|$ is always an even number (since neighboring pulses are always at least two samples apart). Since $P(|s_k - s_i|)$ is the same for the even pulse locations and for the odd pulse locations, one needs only to calculate P(2l), $0 \leqq 2l \leqq 2N-1$, for either the even or the odd pulse locations.

For the second embodiment (with the covariance matrix R), the following operations are performed:

Since the matrix R is symmetrical, only one half of the matrix, plus its diagonal line, are computed in initialization step 40B, as follows:

$$R[l, m] = \sum_{n=\max[l,m]}^{N-1} h(n-l)h(n-m),\quad 0 \leqq l \leqq N-1,\ 0 \leqq m \leqq N-1 \tag{15}$$

where R[l,m] is one element in the matrix R.

In this embodiment, the global criterion $GC_j$ is determined (in step 76B of FIG. 8B) from the cross-correlation vector $r_{th}$ and the covariance matrix R, as follows:

$$GC_j = 2G_j \sum_{k=0}^{M-1} \beta_k r_{th}(s_k) - G_j^2 \sum_{k=0}^{M-1} R(s_k, s_k) - 2G_j^2 \sum_{k=0}^{M-1} \sum_{i=k+1}^{M-1} \beta_k \beta_i R(s_k, s_i) \tag{16}$$

The global criterion of equations 14 and 16 can be implemented for the pulse train embodiment also. In that embodiment, equations 13–16 are similar except that they operate on the impulse response $h_\tau[n]$ rather than on h[n] and the pulses $s_k$ include all of the pulses in the pulse trains which form the pulse train sequence.

The global criterion calculation of this alternative embodiment can also be implemented for the embodiment which restricts the pulse positions to either the odd or even sample positions. For this embodiment, the matrix R can be calculated separately for each subgroup. Alternatively, Applicants have determined that, as for the previous autocorrelation embodiment, a single matrix R, say for the even sample positions, can be utilized for both subgroups. Applicants have determined that the corresponding degradation in quality is negligible and, by utilizing only a single matrix, fewer computation operations are required and a significantly smaller matrix R is necessary.

The subgroup matrix R is determined as follows:

$$R[l, m] = \sum_{n=\max[l,m]}^{N-1} h(n-2l)h(n-2m),\quad 0 \leqq 2l \leqq N-1,\ 0 \leqq 2m \leqq N-1 \tag{17}$$

It will be appreciated that the systems of FIGS. 1, 5 and 7 can be implemented on a digital signal processing chip or in software. In one embodiment, the software was written in the programming language $C_{++}$in another in Assembly language.

It will be appreciated by persons skilled in the art that the present invention is not limited to what has been particularly shown and described hereinabove. Rather the scope of the present invention is defined only by the claims which follow:

We claim:

1. A speech processing system comprising:

a. a short-term analyzer connected to an input and an output line wherein, in response to an input speech signal on said input line, said short-term analyzer generates short-term characteristics of said input speech signal;

b. a target vector generator for generating a target vector from at least said input speech signal and, optionally, said short-term characteristics; and c. a multi-pulse analyzer connected to an output line of said target vector generator, wherein said multi-pulse analyzer generates a plurality of sequences of equal amplitude, variable sign, variably spaced pulses, each of said sequences having a different amplitude value, each of said pulses within each sequence having equal amplitudes but variable signs, said multi-pulse analyzer for outputing a signal corresponding to the sequence of equal amplitude, variable sign, variably spaced pulses which, according to maximum likelihood criteria, most closely represents said target vector, wherein said maximum likelihood criteria are based on the cross-correlation of said target vector with an impulse response for the pulses in each sequence and on a covariance matrix of said impulse response.

2. A speech processing system incorporating a short term analyzer for generating short term characteristics utilizing linear prediction coefficient analysis on an input speech signal, comprising:

a. a target vector generator for generating a target vector from at least said input speech signal and, optionally, the short term characteristics;

b. an initial pulse location determiner for determining the location of an initial pulse in accordance with multi-pulse analysis techniques, based on said target vector and the short term characteristics;

c. an amplitude range determiner for determining both an amplitude of said initial pulse and a range of quantized amplitude levels grouped around the absolute value of said amplitude;

d. an amplitude level selector for stepping through said range of quantized amplitude levels in accordance with a predetermined step size, said amplitude level selector outputing a selected quantized amplitude at each step;

e. a pulse sequence determiner for generating, based on said selected quantized amplitude, a sequence of equal amplitude, variable sign, variably spaced pulses which corresponds to said target vector;

f. initializing means for initially generating a general cross-correlation vector of said target vector with impulse responses at every possible sample position and a general covariance matrix for impulse responses at every possible sample position; and g. a target vector marcher for determining an error vector for each said pulse sequence from said general cross-correlation vector and said general covariance matrix and corresponding to the quality of the match between said pulse sequence and said target vector, for determining said error vector for each of said selected amplitudes, and for outputing the pulse sequence that corresponds to a minimum error vector.

3. A speech processing system according to claim 2 and wherein said pulse sequence determiner includes means for creating pulse sequences having only even and only odd pulse locations and wherein said initializing means creates a single general covariance matrix for said only even pulse locations.

4. A speech processing system comprising:

a. a short-term analyzer connected to an input and an output line wherein, in response to an input speech signal on said input line, said short-term analyzer generates short-term characteristics of said input speech signal;

b. a target vector generator for generating a target vector from at least said input speech signal and, optionally, said short-term characteristics; and c. a multi-pulse analyzer connected to an output line of said target vector generator, wherein said multi-pulse analyzer generates a plurality of sequences of equal amplitude, variable sign, variably spaced pulses, each of said sequences having a different amplitude value, each of said pulses within each sequence having equal amplitudes but variable signs, said multi-pulse analyzer for outputing a signal corresponding to the sequence of equal amplitude, variable sign, variably spaced pulses which, according to maximum likelihood criteria, most closely represents said target vector, wherein said maximum likelihood criteria are based on the cross-correlation of said target vector with an impulse response for the pulses in each sequence and on an autocorrelation vector of said impulse response.

5. A speech processing system incorporating a short term analyzer for generating short term characteristics utilizing linear prediction coefficient analysis on an input speech signal, comprising:

a. a target vector generator for generating a target vector from at least said input speech signal and, optionally, the short term characteristics;

b. an initial pulse location determiner for determining the location of an initial pulse in accordance with multi-pulse analysis techniques, based on said target vector and the short term characteristics;

c. an amplitude range determiner for determining both an amplitude of said initial pulse and a range of quantized amplitude levels grouped around the absolute value of said amplitude;

d. an amplitude level selector for stepping through said range of quantized amplitude levels in accordance with a predetermined step size, said amplitude level selector outputting a selected quantized amplitude at each step;

e. an pulse sequence determiner for generating, based on said selected quantized amplitude, a sequence of equal amplitude, variable sign, variably spaced pulses which corresponds to said target vector;

f. initializing means for initially generating a general cross-correlation vector of said target vector with impulse responses at every possible sample position and a general autocorrelation vector for impulse responses at every possible sample position; and g. a target vector matcher for determining an error vector for each said pulse sequence from said general cross-correlation vector and said general autocorrelation vector and corresponding to the quality of the match between said pulse sequence and said target vector, for determining said error vector for each of said selected amplitudes, and for outputing the pulse sequence that corresponds to a minimum error vector.

6. A speech processing system according to claim 4 and wherein said pulse sequence determiner includes means for creating pulse sequences having only even and only odd pulse locations and wherein said initializing means creates a single general autocorrelation vector for said only even pulse locations.

7. A speech processing system comprising:

a. a short-term analyzer connected to said input line and to an output line wherein, in response to said input speech signal on said input line, said short-term analyzer generates short-term characteristics of said input speech signal;

b. a target vector generator for generating a target vector from at least said input speech signal and, optionally, at least the short term characteristics; and c. a pulse train multi-pulse analyzer, connected to an output line of said target vector generator for generating a plurality of sequences of variable sign trains of equal amplitude, uniformly spaced pulses, said pulses within each train having the same sign, and each of said sequences of trains of pulses having a different amplitude value said pulse train multi-pulse analyzer outputing a signal corresponding to the plurality of trains of equal amplitude, uniformly spaced pulses which, in accordance with maximum likelihood criteria, most closely represents said target vector, wherein said maximum likelihood criteria are based on the cross-correlation of said target vector with an impulse response for the pulses in each sequence and on a covariance matrix of said impulse response.

8. The system according to claim 7 and also including a long-term analyzer connected to an input and an output line wherein, in response to an input speech signal on said input line, said long-term analyzer generates long term characteristics including at least a pitch value of said input speech signal and wherein each of said pulses within each said train of pulses is separated from each other by said pitch value.

9. A speech processing system comprising:

a. a short-term analyzer connected to said input line and to an output line wherein, in response to said input speech signal on said input line, said short-term analyzer generates short-term characteristics of said input speech signal;

b. a target vector generator for generating a target vector from at least said input speech signal and, optionally, at least the short term characteristics; and c. a pulse train multi-pulse analyzer, connected to an output line of said target vector generator for generating a plurality of sequences of variable sign trains of equal amplitude, uniformly spaced pulses, said pulses within each train having the same sign, and each of said sequences of trains of pulses having a different amplitude value said pulse train multi-pulse analyzer outputing a signal corresponding to the plurality of trains of equal amplitude, uniformly spaced pulses which, in accordance with maximum likelihood criteria, most closely represents said target vector, wherein said maximum likelihood criteria are based on the cross-correlation of said target vector with an impulse response for the pulses in each sequence and on an autocorrelation vector of said impulse response.

10. The system according to claim 8 and also including a long-term analyzer connected to an input and an output line wherein, in response to an input speech signal on said input line, said long-term analyzer generates long term characteristics including at least a pitch value of said input speech signal and wherein each of said pulses within each said train of pulses is separated from each other by said pitch value.

11. A speech processing system incorporating a short term analyzer for generating short term characteristics utilizing linear prediction coefficient analysis from an input speech signal and incorporating a long term analyzer for determining long term characteristics including a pitch value of speech from the input speech signal, the system comprising:

a. a target vector generator for generating a target vector from at least said input speech signal and, optionally, the short term and long term characteristics;

b. an initial pulse train location determiner for determining the location of an initial pulse train in accordance with multi-pulse analysis techniques, based on said target vector, the short term characteristics and the pitch value;

c. an amplitude range determiner for determining both an amplitude of said initial pulse train and a range of quantized amplitude levels grouped around the absolute value of said amplitude;

d. an amplitude level selector for stepping through said range of quantized amplitude levels in accordance with a predetermined step size, said amplitude level selector outputing a selected quantized amplitude at each step;

e. a pulse train sequence determiner for generating, for each of said selected quantized amplitudes, a plurality of variable sign trains of equal amplitude, uniformly spaced pulses which corresponds to said target vector, said pulses within said trains having a pulse spacing corresponding to the pitch value, said pulses within each train having the same sign, said pulses within each train of pulses having an equal amplitude, said equal amplitude corresponding to said selected quantized amplitude;

f. initializing means for initially generating a general cross-correlation vector of said target vector with impulse responses at every possible sample position and a general covariance matrix for impulse responses at every possible sample position; and g. a target vector matcher for determining an error vector for each said pulse train sequence from said general cross-correlation vector and said general covariance matrix and corresponding to the quality of the match between said plurality of pulse train sequences and said target vector, for determining said error vector for each of said selected amplitudes, and for outputing the sequence of pulse trains that corresponds to a minimum error vector.

12. The system according to claim 11 further comprising:

a. a multi-pulse analyzer connected to said output line of said target vector generator, wherein said multi-pulse analyzer generates a plurality of sequences of equal amplitude, variable sign, variably spaced pulses, each of said sequences having a different amplitude value, each of said pulses within each sequence having equal amplitudes but variable signs, said multi-pulse analyzer for outputing a signal corresponding to the sequence of equal amplitude, variable sign, variably spaced pulses which, according to maximum likelihood criteria, most closely represents said target vector, wherein said maximum likelihood criteria are based on the cross-correlation of said target vector with an impulse response for the pulses in each sequence and a covariance matrix of said impulse response; and b. a comparator receiving output from both said target vector matcher and said multi-pulse analyzer for selecting the output which best matches said target vector.

13. A speech processing system incorporating a short term analyzer for generating short term characteristics utilizing linear prediction coefficient analysis from an input speech signal and incorporating a long term analyzer for determining long term characteristics including a pitch value of speech from the input speech signal, the system comprising:

a. a target vector generator for generating a target vector from at least said input speech signal and, optionally, the short term and long term characteristics;

b. an initial pulse train location determiner for determining the location of an initial pulse train in accordance with multi-pulse analysis techniques, based on said target vector, the short term characteristics and the pitch value;

c. an amplitude range determiner for determining both an amplitude of said initial pulse train and a range of quantized amplitude levels grouped around the absolute value of said amplitude;

d. an amplitude level selector for stepping through said range of quantized amplitude levels in accordance with a predetermined step size, said amplitude level selector outputing a selected quantized amplitude at each step;

e. a pulse train sequence determiner for generating, for each of said selected quantized amplitudes, a plurality of variable sign trains of equal amplitude, uniformly spaced pulses which corresponds to said target vector, said pulses within said trains having a pulse spacing corresponding to the pitch value, said pulses within each train having the same sign, said pulses within each train of pulses having an equal amplitude, said equal amplitude corresponding to said selected quantized amplitude; and f. initializing means for initially generating a general cross-correlation vector of said target vector with impulse responses at every possible sample position and a general autocorrelation vector for impulse responses at every possible sample position; and g. a target vector matcher for determining an error vector for each said pulse train sequence from said general cross-correlation vector and said general autocorrelation vector and corresponding to the quality of the match between said plurality of pulse train sequences and said target vector, for determining said error vector for each of said selected amplitudes, and for outputing the sequence of pulse trains that corresponds to a minimum error vector.

14. The system according to claim 13 further comprising:

a. a multi-pulse analyzer connected to said output line of said target vector generator, wherein said multi-pulse analyzer generates a plurality of sequences of equal amplitude, variable sign, variably spaced pulses, each of said sequences having a different amplitude value, each of said pulses within each sequence having equal amplitudes but variable signs, said multi-pulse analyzer for outputing a signal corresponding to the sequence of equal amplitude, variable sign, variably spaced pulses which, according to maximum likelihood criteria, most closely represents said target vector, wherein said maximum likelihood criteria are based on the cross-correlation of said target vector with an impulse response for the pulses in each sequence and an autocorrelation vector of said impulse response; and b. a comparator receiving output from both said target vector matcher and said multi-pulse analyzer for selecting the output which best matches said target vector.

15. A method of speech processing comprising the steps of:

a. determining short-term characteristics of an input speech signal;

b. generating a target vector from at least said input speech signal and, optionally, from said short-term characteristics;

c. determining the location of an initial pulse in accordance with multi-pulse analysis techniques, based on said target vector and said short-term characteristics;

d. determining both an amplitude of said initial pulse and a range of quantized amplitude levels grouped around the absolute value of said amplitude;

e. stepping through said range of quantized amplitude levels in accordance with predetermined step size and outputing a selected quantized amplitude at each step;

f. generating, based on said selected quantized amplitude, a sequence of equal amplitude, variable sign, variably spaced pulses which corresponds to said target vector;

g. comparing each said sequence of equal amplitude, variable sign, variably spaced pulses to said target vector; and h. selecting said sequence of equal amplitude, variable sign, variably spaced pulses which, in accordance with a maximum likelihood criterion, most closely represents said target vector, wherein said maximum likelihood criteria are based on the cross-correlation of said target vector with an impulse response for the pulses in each sequence and an autocorrelation vector of said impulse response.

16. A method of speech processing comprising the steps of:

a. determining short-term characteristics of an input speech signal;

b. generating a target vector from at least said input speech signal and, optionally, from said short-term characteristics;

i. determining the location of an initial pulse in accordance with multi-pulse analysis techniques, based on said target vector and said short-term characteristics;

ii. determining both an amplitude of said initial pulse and a range of quantized amplitude levels grouped around the absolute value of said amplitude;

iii. stepping through said range of quantized amplitude levels in accordance with predetermined step size and outputing a selected quantized amplitude at each step;

iv. generating, based on said selected quantized amplitude, a sequence of equal amplitude, variable sign, variably spaced pulses which corresponds to said target vector;

v. comparing each said sequence of equal amplitude, variable sign, variably spaced pulses to said target vector; and vi. selecting said sequence of equal amplitude, variable sign, variably spaced pulses which, in accordance with a maximum likelihood criterion, most closely represents said target vector, wherein said maximum likelihood criteria are based on the cross-correlation of said target vector with an impulse response for the pulses in each sequence and a covariance matrix of said impulse response.

17. A method of speech processing comprising the steps of:

a. determining short-term characteristics of said input speech signal;

b. determining long-term characteristics of said input speech signal including at least a pitch value of said input speech signal;

c. generating a target vector from at least said input speech signal, and, optionally, from said short-term and long-term characteristics;

d. determining the location of an initial pulse train in accordance with multi-pulse analysis techniques, based on said target vector, the short-term characteristics and the pitch value;

e. determining both an amplitude of said initial pulse train and a range of quantized levels grouped around the absolute value of said amplitude;

f. stepping through said range of quantized amplitude levels in accordance with a predetermined step size and outputing a selected quantized amplitude at each step;

g. generating, for each selected quantized amplitude, a plurality of variable sign trains of equal amplitude, uniformly spaced pulses which correspond to said target vector, said pulses within said trains of pulses having a pulse spacing corresponding to said pitch value, said pulses within each said train of pulses having the same amplitude, said same amplitude corresponding to the selected quantized amplitude, the pulses within each train having the same sign;

h. comparing said plurality of variable sign trains of equal amplitude, uniformly spaced pulses to said target vector; and i. selecting said plurality of variable sign trains of equal amplitude, uniformly spaced pulses which, in accordance with maximum likelihood criteria, most closely represents said target vector, wherein said maximum likelihood criteria are based on the cross-correlation of said target vector with an impulse response for the pulses in each sequence and a covariance matrix of said impulse response.

18. A method of speech processing comprising the steps of:

a. determining short-term characteristics of said input speech signal;

b. determining long-term characteristics of said input speech signal including at least a pitch value of said input speech signal;

c. generating a target vector from at least said input speech signal, and, optionally, from said short-term and long-term characteristics;

d. determining the location of an initial pulse train in accordance with multi-pulse analysis techniques, based on said target vector, the short-term characteristics and the pitch value;

e. determining both an amplitude of said initial pulse train and a range of quantized levels grouped around the absolute value of said amplitude;

f. stepping through said range of quantized amplitude levels in accordance with a predetermined step size and outputing a selected quantized amplitude at each step;

g. generating, for each selected quantized amplitude, a plurality of variable sign trains of equal amplitude, uniformly spaced pulses which correspond to said target vector, said pulses within said trains of pulses having a pulse spacing corresponding to said pitch value, said pulses within each said train of pulses having the same amplitude, said same amplitude corresponding to the selected quantized amplitude, the pulses within each train having the same sign;

h. comparing said plurality of variable sign trains of equal amplitude, uniformly spaced pulses to said target vector; and i. selecting said plurality of variable sign trains of equal amplitude, uniformly spaced pulses which, in accordance with maximum likelihood criteria, most closely represents said target vector, wherein said maximum likelihood criteria are based on the cross-correlation of said target vector with an impulse response for the pulses in each sequence and an autocorrelation vector of said impulse response.

* * * * *